United States Patent [19]

Ripley

[11] Patent Number: 4,723,406

[45] Date of Patent: Feb. 9, 1988

[54] EXPANSIBLE LINKAGE FOR USE IN MAKING A WATCHBAND OR SIMILAR ARTICLE

[75] Inventor: Richard E. Ripley, Attleboro, Mass.

[73] Assignee: Textron, Inc., Providence, R.I.

[21] Appl. No.: 33,724

[22] Filed: Apr. 8, 1987

Related U.S. Application Data

[63] Continuation-in-part of Ser. No. 857,877, May 1, 1986, abandoned.

[51] Int. Cl.[4] ..... A44C 5/04

[52] U.S. Cl. ..... 59/79.1; 59/79.3; 63/5.1

[58] Field of Search ..... 59/79.1, 79.2, 79.3, 59/80; 63/5 R, 6

[56] References Cited

U.S. PATENT DOCUMENTS 3,344,599 10/1967 Hauser ..... 59/79.1

3,786,629 1/1974 Rieth ..... 59/79.1

*Primary Examiner*—Robert L. Spruill

*Assistant Examiner*—David B. Jones

*Attorney, Agent, or Firm*—Samuels, Gauthier, Stevens & Kehoe

[57] ABSTRACT

This invention involves an expansible band construction which allows a wide latitude in the design of outer decorative shells, thereby permitting the simulation of chain link type bracelets and other popular styles not available before in an expansion band. This is accomplished by constructing the outer links of the band with a smaller width than the width of the inner link. The band in its contracted state will therefore have significant gaps between adjacent outer links.

4 Claims, 8 Drawing Figures

EXPANSIBLE LINKAGE FOR USE IN MAKING A WATCHBAND OR SIMILAR ARTICLE

RELATIONSHIP TO OTHER APPLICATIONS

This application is a continuation-in-part of U.S. patent application Ser. No. 857,877 filed May 1, 1986 now abandoned.

THE BACKGROUND OF THE INVENTION

Expansion bands are well known in the prior art and are typically constructed of interconnected outer and inner overlapping links. Each outer link is connected to a pair of inner links by means of U-shaped connecting members commonly referred to as "staples". The links are generally shaped as elongated hollow boxes with openings at either end to receive the legs of the staples. The staples are retained in engagement with the inner and outer links by folded end tabs or other means. Groups of links are connected in an adjacent line to form a band of an appropriate length. A force tending to stretch the band will pivot the staples within each link to separate the links and provide an expansion capability of around 3 to 5 inches. Springs provided in the links yieldingly resist the pivoting motion of the staples, thereby biasing the band into a contracted state. In the contracted state the outer links meet so that adjacent sides of successive links are touching to provide a pleasing decorative outer finish to the band. In this state, the staples extend generally perpendicular to a reference plane extending between the overlapping inner and outer links. FIG. 1 is illustrative of this prior art construction.

The following patents all show variations of this construction and are also typical of the prior art:

U.S. Pat. Nos. 2,689,450; 3,158,989; 2,918,785; 3,307,347; 2,799,135; 3,307,348; 2,941,351; 3,315,463; 2,957,303; 3,543,507; 3,786,629.

The decorative appearances of the prior art bands is provided either by the outer faces of the outer links, or more preferably by top shells applied as decorative covers to the outer links. Until now, the variety of styles available through the use of decorative top shells has been significantly limited by functional considerations relating to band expandability. More particularly, those skilled in the art are well aware of the necessity to provide a spacing between the inner links of a contacted band in order to avoid pinching the skin and hair on a wearer's wrist. However, such spacing must be kept to a minimum, for otherwise the expandability of the band will be unacceptably compromised.

In the prior art bands, the inner and outer links either have substantially equal width dimensions (U.S. Pat. No. 2,799,135), or the outer links are wider than the inner links (U.S. Pat. No. 3,786,629). In both cases, the extent to which the top shells can protrude laterally beyond the widths of the outer links is severely limited because any such protrusions further increase the spacing between the inner links, with a concomitant decrease in expandability. Thus, the top shells must either substantially conform in design as well as in size to the underlying outer links (FIG. 1 of U.S. Pat. No. 2,799,135 and FIG. 13 of U.S. Pat. No. 3,786,629), or the outer links must themselves be specially contoured to accommodate the design of the top shells (FIGS. 14–17 of U.S. Pat. No. 3,786,629).

The first alternative stifles design freedom, and the second alternative is equally unacceptable in that it requires specially designed outer links to be provided for each top shell variation.

A primary objective of the present invention is to provide an expansion band wherein the inner and outer links are dimensionally related in a manner such as to accommodate significantly greater lateral protrusions of the top shells beyond the widths of the outer links.

A companion objective of the present invention is to provide an expansion band which allows a wide variety of decorative shells to be applied to the outer links without unduly restricting the expansion capability of the band, and without requiring specially contoured outer links for each top shell design.

BRIEF SUMMARY OF THE INVENTION

An expansion band is constructed having outer links which are significntly narrower in width in comparison to the underlying inner links, thereby establishing substantial gaps between the outer links when the band is fully contracted. Decorative top shells are applied to the top links. The top shells have decoratively contoured side walls, with portions thereof which are arranged to engage the side walls of the outer links, and with other portions thereof which are spaced from the outer link side walls and which protrude into the aforesaid gaps. The combined result is a uniquely decorative and pleasing appearance which has heretofore been impossible to achieve with prior art expansion band constructions. Preferably, the top shells have interengaging lateral protrusions and recesses providing an interlocked design which can simulate any one of a wide variety of decorative patterns, including for example braided mesh or link-type designs. Preferbly, there is a slight interference fit between adjacent top shells which establishes the required small spacing between the inner links.

DESCRIPTION OF THE DRAWINGS

A preferred embodiment of the present invention is described hereinafter in more detail with reference to the accompanying drawings, wherein.

DETAILED DESCRIPTION OF THE INVENTION

Referring now to FIGS. 2–8, an expansion band in accordance with the present invention is shown at 10.

The band includes a row of inner links 12 extending laterally with respect to the length "L" of the bracelet. The inner links have hollow box-like constructions, with end tabs 14, and with side walls defining first width dimensions "X".

A row of outer links 16 overlies the row of inner links. The outer links also extend laterally with respect to the length L of the bracelet, and likewise have box-like constructions with end tabs 18 and side walls defining second width dimensions "Y".

Figure 1:
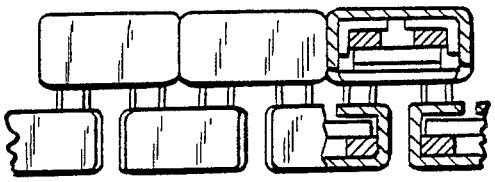
FIG. 1 (PRIOR ART)
FIG. 1 is an illustration of an expansion band of the prior art.
Figure 2:
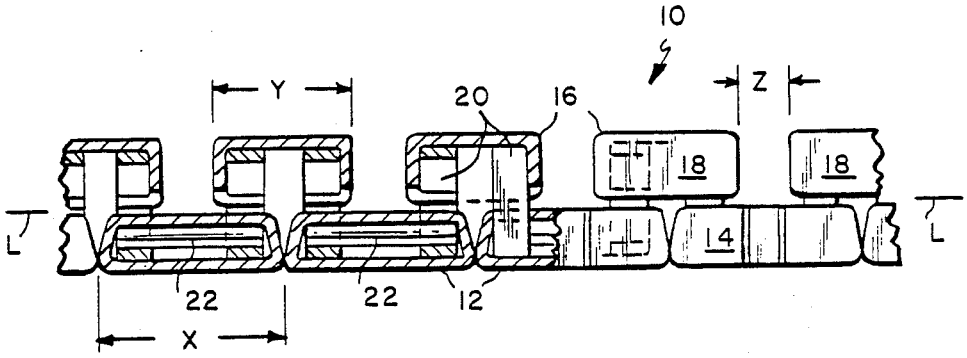
FIG. 2 is a side view, partially cut away, of an expansion band constructed in accordance with this invention, without decorative top shells applied to the outer links.
Figure 3:
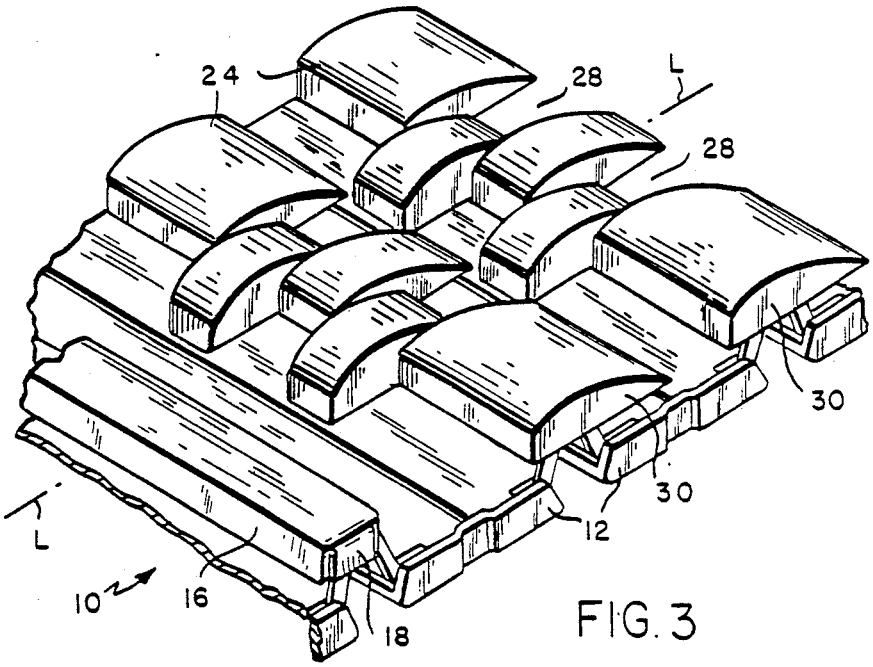
FIG. 3 is a perspective view of a portion of the expansion band of this invention, partially expanded, with decorative shells in place on some of the outer links.
Figure 4:
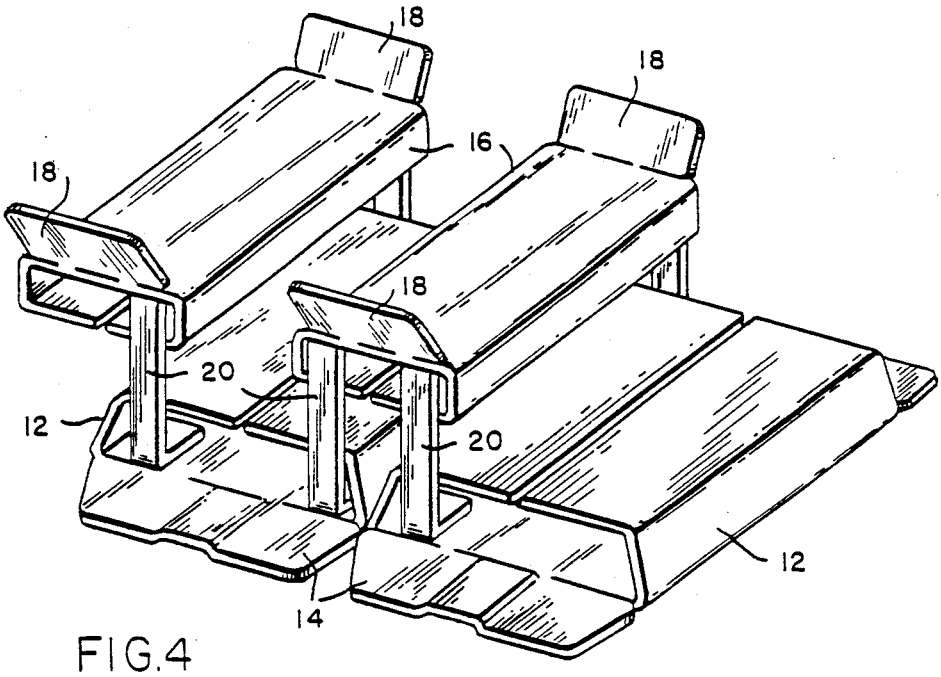
FIG. 4 is a perspective view of a portion of the expansion band of this invention showing the relationship between the inner and outer links at an intermediate stage during the assembly of the band.

The inner and outer links 12,16 are staggered in relation to each other in the direction of the bracelet length L, and are interconnected by means of U-shaped staples 20. During assembly, as shown in FIG. 4, the end tabs 14,18 of the inner and outer links 12,16 are open to accept the staple legs. Resilient leaf springs 22 in the inner links 12 bias the staples into the vertical positions shown in FIG. 2. Absent any other interference or external force, this causes the wider inner links 12 to abut each other. The width dimensions Y of the outer links 16 are significantly smaller than the width dimension X of inner links 12, with the result that substantial gaps "Z" remain between adjacent outer links 16.

The inner and outer links 12,16 together with the staples 20 and springs 22 constitute a basic "skeleton" structure which can be mass produced and employed with a wide variety of decorative top shells, a typical example of which is illustrated at 24 in FIGS. 3 and 5–8.

Figure 5:
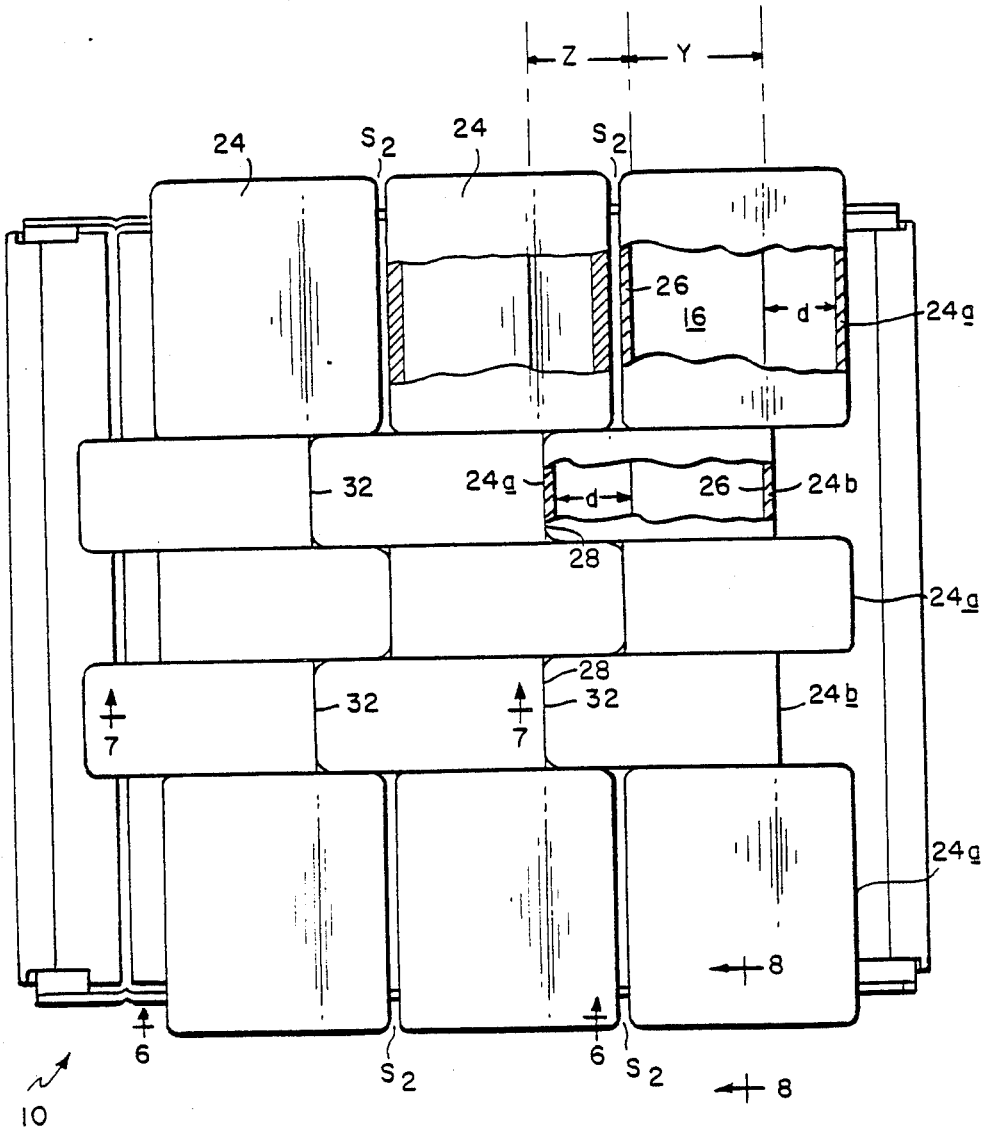
FIG. 5 is a plan view of the expansion band shown in FIG. 3, with the links in the contracted state.
Figure 6:
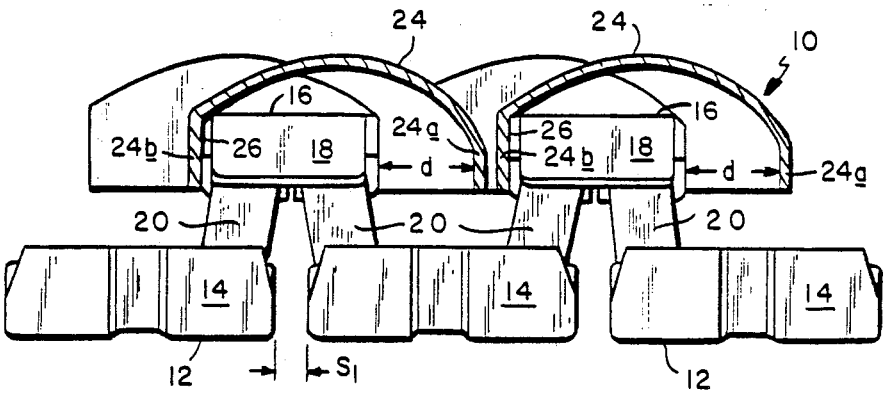
FIGS. 6 and 7 are sectional views taken respectively along lines 6—6 and 7—7 of FIG. 5.
Figure 7:
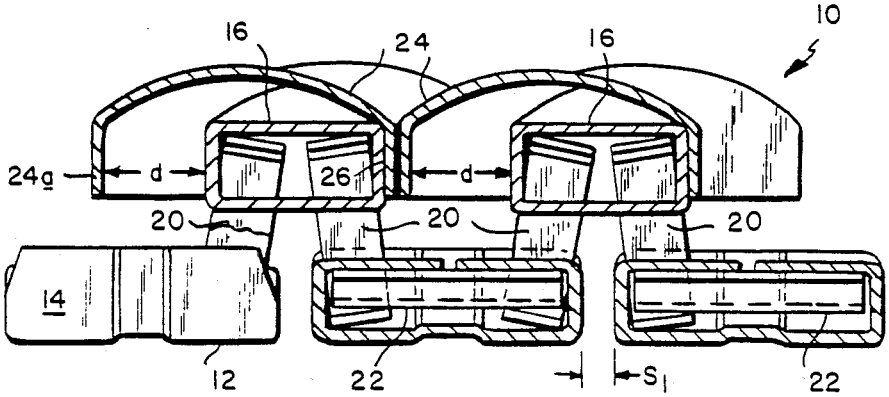

The top shells 24 cover the outer links 16 and have contoured side walls which include both laterally protruding portions 24*a* and recessed portions 24*b*. As can be best seen in FIGS. 5–7, the laterally protruding side wall portions 24*a* of the top shells are spaced laterally from the sides of the respective underlying outer links 16 by a distance "d", whereas the recessed side wall portions 24*b* engage the respective outer links 16 at contact areas 26. The contact areas 26 serve to laterally locate each top shell on its respective outer link. The recessed wall portions 24*b* cooperate with the laterally protruding wall portions 24*a* to define recesses 28 (see FIG. 3). As shown in FIG. 5, the laterally protruding wall portions 24*a* of each top shell 24 are received in the recesses 28 of the adjacent top shells. The wall portions 24*a* and recesses 28 are located exclusively within the gaps Z, and do not intrude into the width dimensions Y of the outer links 16. Thus, when the band is in the contracted state shown in FIGS. 5–7, the laterally protruding wall sections 24*a* of each top shell enter the recesses 28 of the adjacent shells and fill the gaps Z.

Figure 8:
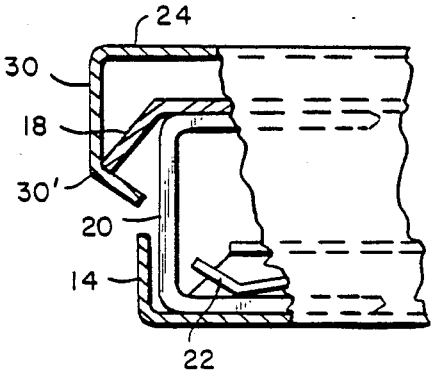
FIG. 8 is another partial sectional view on line 8—8 of FIG. 5 showing details of the interengagement between the end tabs of the outer links and the end tabs of the decorative top shells.

As shown in FIG. 8, the end tabs 18 of the outer links 16 are inclined angularly outwardly, and are overlapped by end tabs 30 on the top shells. The end tabs 30 are bent inwardly at 30' and thus coact in mechanical engagement with the end tabs 18 to lock the top shells onto their respective underlying outer links.

Preferably, at least some of the laterally protruding side wall portions 24*a* of the top shells 24 abut the recessed side wall portions 24*b* of adjacent shells as at 32 (see FIG. 5), thereby providing an interfering relationship which serves to establish a small spacing $s_1$ between adjacent inner links 12, as well as a slight spacing $s_2$ between the adjacent top shells 24 along the sides of the band. The spacings $s_1$; $s_2$ serve to prevent pinching of skin and hair.

I claim:

1. An expansion band comprising:

a row of inner links extending transversally with respect to the length of the band and having first width dimensions measured in the direction of said length;

a row of outer links overlying the row of inner links, said outer links also extending transversally with respect to the length of the band, said inner and outer links being staggered in relation to each other in the direction of said length and said outer links having second width dimensions measured in the direction of said length which are smaller than said first width dimensions;

means for interconnecting and resiliently urging said inner and outer links into a contracted state at which said inner links abut each other and said outer links are spaced one from the other by gaps overlying said inner links; and decorative top shells covering said outer links, said top shells having contoured side walls on opposite sides of each outer link, said contoured side walls including first wall portions spaced from the respective underlying outer links in the direction of said length, and second wall portions contacting the respective underlying outer links and cooperating with said first wall portions to form recesses overlying said gaps and opening in the direction of said length the first wall portions of each top shell being received in the recesses of the adjacent top shells when said links are in the contracted state.

2. The expansion band of claim 1 wherein at least some of the first wall portions of each top shell abut the second wall portions of adjacent top shells to provide an interfering relationship which establishes a lateral spacing between said inner links.

3. The expansion band of claim 1 wherein said outer links have angularly outwardly inclined end tabs, and wherein said top shells have end tabs which overlap and coact with said outwardly inclined end tabs to lock said top shells onto the respective underlying outer links.

4. An expansion band comprising: a row of inner links extending transversally with respect to the length of the band and having first side walls defining first width dimensions measured in the direction of said length; a row of outer links overlying the row of inner links, said outer links also extending transversally with respect to the length of the band, said inner and outer links being staggered in relation to each other in the direction of said length and said outer links having second side walls defining second width dimensions measured in the direction of said length, said second width dimensions being smaller than said first width dimensions; means for interconnecting and resiliently urging said inner and outer links into a contracted state at which said second side walls are spaced one from the other by gaps overlying said inner links; and decorative top shells covering said outer links, said top shells having contoured side walls on opposite sides of each outer link, said contoured side walls including first wall portions spaced from the second side walls of the respective underlying outer links, and second wall portions contacting the second side walls of the respective underlying outer links, said second wall portions cooperating with said first wall portions to form open recesses overlying said gaps, said first wall portions of each top shell being received in the recesses of the adjacent top shells when said links are in the contracted state, with said first and second wall portions and said recesses being located exclusively over said gaps.

* * * * *